US007134231B1

(12) United States Patent
Becker

(10) Patent No.: US 7,134,231 B1
(45) Date of Patent: Nov. 14, 2006

(54) TAG CLIP WITH CARD CARRIER

(76) Inventor: Fred R. Becker, P.O. Box 101, Horsham, PA (US) 19044-0101

( * ) Notice: Subject to any disclaimer, the term of this patent is extended or adjusted under 35 U.S.C. 154(b) by 33 days.

(21) Appl. No.: 10/743,837

(22) Filed: Dec. 24, 2003

(51) Int. Cl.
*G09F 3/20* (2006.01)

(52) U.S. Cl. ..... 40/658; 24/67.5; 24/336

(58) Field of Classification Search ..... 40/658, 40/647, 299.01, 666, 652; 24/67.5, 67.3, 24/67.9, 336, 531, 558
See application file for complete search history.

(56) References Cited

U.S. PATENT DOCUMENTS 1,782,057 A * 11/1930 Bollinger ..... 24/301
4,170,299 A * 10/1979 Clements ..... 206/342
5,117,538 A * 6/1992 Henry ..... 24/298
5,655,270 A * 8/1997 Boisvert ..... 24/336
5,852,849 A * 12/1998 Lansing et al. ..... 24/3.4
5,884,371 A * 3/1999 Huggins ..... 24/300
2002/0152948 A1* 10/2002 Percle ..... 116/209

* cited by examiner

*Primary Examiner*—Gary C. Hoge
(74) *Attorney, Agent, or Firm*—Richard L. Huff

(57) ABSTRACT

A first embodiment card-holding device containing a clip, an intermediate piece, and a carrier. A second embodiment contains a first clip, an intermediate piece, and a second clip. A third embodiment contains a clip and a carrier. The intermediate part or the carrier is attached to the clip by a connector piece having a first piece secured to the inner surface of the clip and a second piece secured to the first piece, the outer surface of the clip, and the intermediate piece or the carrier.

3 Claims, 9 Drawing Sheets

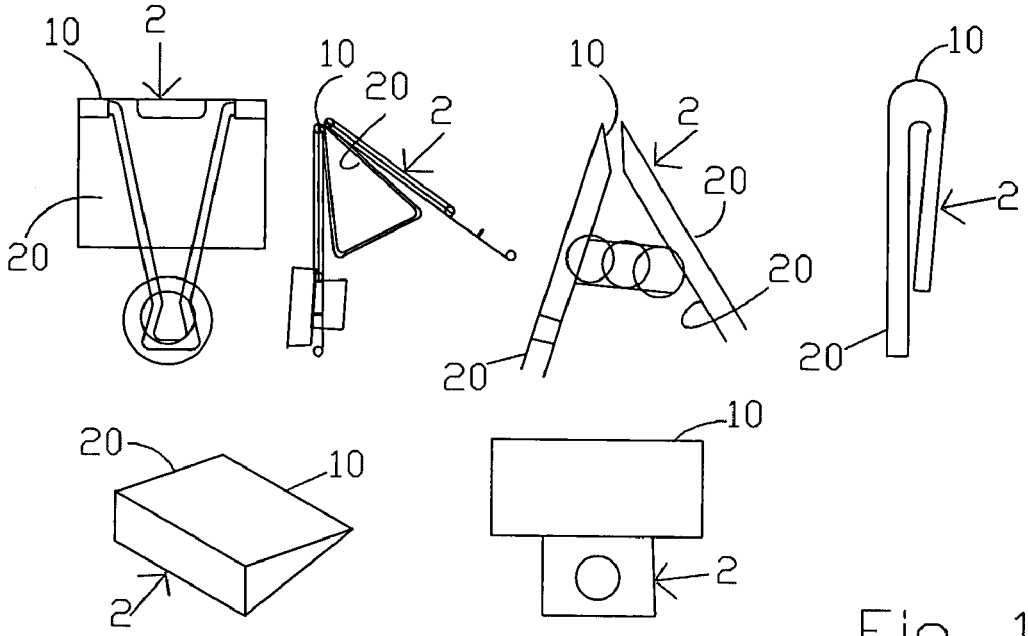
Fig. 10
Fig. 11
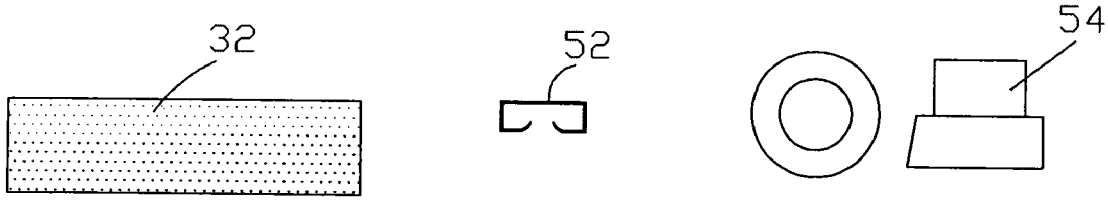

Fig. 15
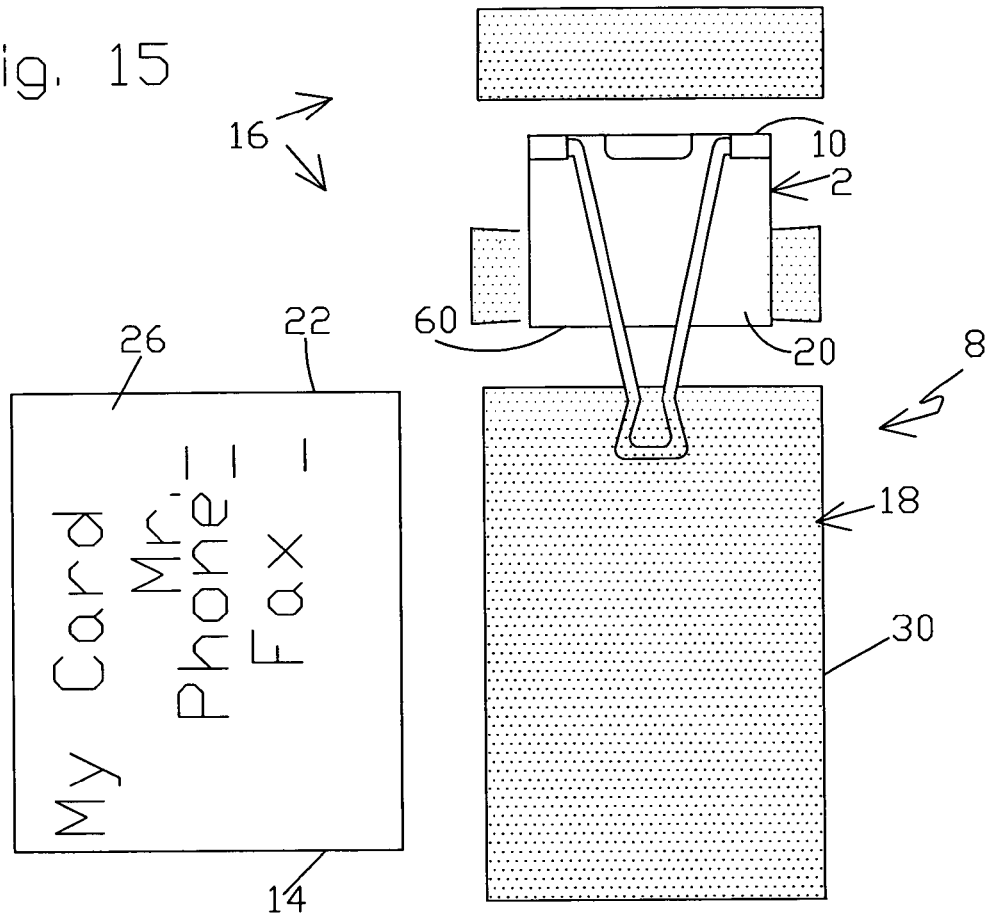
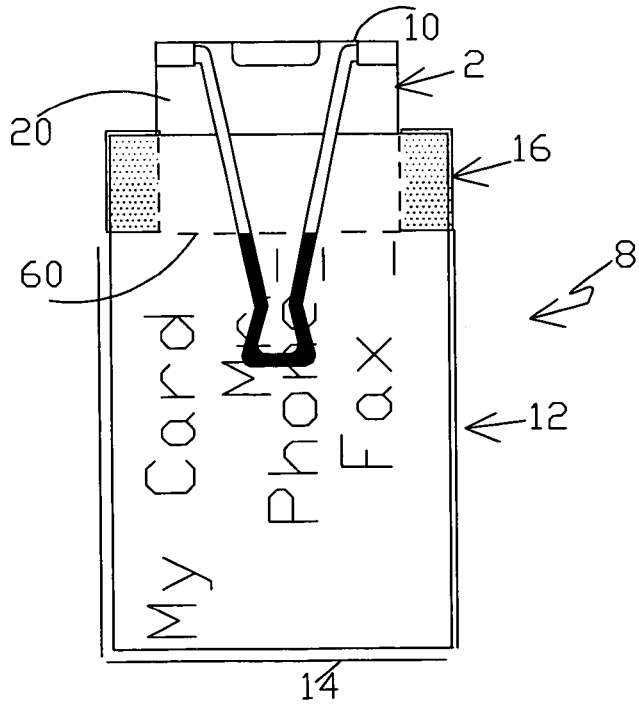
Fig. 16

TAG CLIP WITH CARD CARRIER

CROSS-REFERENCE TO RELATED APPLICATIONS

STATEMENT REGARDING FEDERALLY SPONSORED RESEARCH OR DEVELOPMENT (Not applicable)

REFERENCE TO SEQUENTIAL LISTING, A TABLE, OR A COMPUTER PROGRAM LISTING APPENDIX SUBMITTED ON A COMPACT DISC (Not applicable)

BACKGROUND OF THE INVENTION

1) Field of the Invention

This invention relates to card holders. More specifically, the invention relates to a device for temporarily storing business cards in a safe place between the time the user gets the card and the time the user permanently files the card.

2) Description of the Related Art

The prior art has sophisticated methods of storing business cards. These cards may be kept on a rotatable file where they are physically visible. They may be kept in books having transparent pockets for easy viewing while being kept safe and in order. They may be scanned into computers for permanent storage and retrieval. When a person acquires a business card that he or she intends to keep and file, the person may either immediately and temporarily store the business card in a wallet for safety and ready access or may simply put the card in a pocket or purse until access to the permanent storage location is available. Each of these methods has obvious disadvantages. Storing the card in a wallet involves retrieving the wallet, opening the wallet, inserting the card, closing the wallet, and storing the wallet. Storing the loose card in a pocket or purse runs the risk of the card being damaged or lost. Clips attached to card holders are known in the prior art.

U.S. Pat. No. D345,992, issued to Mohsen Apr. 12, 1994, teaches a tag comprising a clip, a connecting cord, and a tag with a top hole for the cord.

U.S. Pat. No. D436,724, issued to Kojoori Feb. 5, 2000, teaches a wallet and money clip combination. The clip is apparently used to hold dollar bills on the outside of the wallet and is not used for attaching the wallet to anything.

U.S. Published Pat. Application No. 2001/0032690, invented by Gribovsky and published Oct. 25, 2001, teaches a spine which is attached to a money clip. The spine also is attached to the proximal ends of two card holders. The clip serves as a money clip and does not attach the card holders to anything.

U.S. Pat. No. 3,648,832, issued to Kirshenbaum et al Mar. 14, 1972, teaches a card holder which is typically in a folded configuration. The holder cannot close if a card has been removed and not replaced, thus reminding the owner to replace the card. This device apparently works well for its intended purpose. There is no indication that the card holder is attached to anything.

U.S. Pat. No. 3,958,788, issued to Feibelman May 25, 1976, discloses a horizontal bar having a slot, which slot receives one of two curved flanges attached to a display card, thus allowing easy sliding on and off of the bar by the display card. This disclosure does not reveal clipping the card to anything.

U.S. Pat. No. 4,761,862, issued to Hiromori Aug. 9, 1998, U.S. Pat. No. 5,533,236, issued to Tseng Jul. 9, 1996, U.S. Pat. No. 5,896,624, issued to Horswell Apr. 27, 1999, U.S. Pat. No. 5,950,283, issued to Sato Sep. 14, 1999, and U.S. Pat. No. 6,374,463, issued to Kaufman Apr. 23, 2002, disclose clips having spring characteristics. The clips have bodies having a back portion and abutment portions. The abutment portions have free ends to which finger grips are attached. These clips may hold layers of paper. The clips are free standing and are not attached to anything.

U.S. Pat. No. 4,784,199, issued to Wise Nov. 15, 1988, discloses a clip which may be removably attached to a wallet. When attached, the wallet may be carried on the waistband. When detached, the wallet may be carried in the pocket. The wallet is either attached directly to the clip or not attached at all.

U.S. Pat. No. 4,790,435, issued to Trusty Dec. 13, 1988, discloses a carrying case and dispenser for business cards. This case forms part of a belt buckle and is thus limited in its utility.

U.S. Pat. No. 5,313,721, issued to Filden May 24, 1994, discloses a clip which may be attached to clothing. The clip is attached to a card holder or a strap attached to a card holder. While the clip is said to be composed of fewer pieces than earlier clips, it is still complex in design and requires detailed manufacturing. The clip is limited to being attached to thin materials as the holding portion of the clip depends upon a stud and a pin.

U.S. Pat. No. 5,564,166, issued to Roy Oct. 15, 1996, discloses a spring-biased clip attached to a connector having an attaching member with a moveable leg capable of attachment to a badge. The clip would put a shearing pressure on a carrying garment and the badge would not be protected. There is no disclosure referring to carrying cards.

U.S. Pat. No. 5,592,767, issued to Treske Jan. 14, 1997, discloses a card holder attached by snap members to a strap and the strap being attached to a spring clip which may be attached to an object. The card holder attaches to the strap adjacent to the clip with substantially no distance between the clip and the card holder.

U.S. Pat. No. 5,613,602, issued to Lage et al Mar. 25, 1997, discloses a device for be magnetically held to metal surfaces such as refrigerators. The device includes a clip having spring loaded legs which holds an object to be displayed. One of the legs contains a magnet which holds the clip to the metal surface. The other leg contains a carrier which includes a backing panel and a protector for holding and displaying business cards. The usefulness of this device is limited to ferrous surfaces.

U.S. Pat. No. 5,615,454, issued to Contarino Apr. 1, 1997, discloses an alligator clip, a chain, and a split-ring holder for a magnetically encoded card. The card carried by this device is not protected.

U.S. Pat. No. 5,653,276, issued to Niernberger Aug. 5, 1977, discloses a combination of a wallet and a money clip wherein the money clip is covered by a retaining strap. This device does not allow for the display of cards.

U.S. Pat. No. 5,718,329, issued to Ippolito et al Feb. 17, 1998, discloses a combination of a money clip and card holder. The cards fit inside the holder and are not visible.

U.S. Pat. No. 5,727,696, issued to Valiulis Mar. 17, 1998, discloses a transparent holder for business cards which may be supported by a hook. The hook and the card holder are made of a single piece and there is no separation between the two parts.

U.S. Pat. No. 6,108,957, issued to Zapawa Aug. 29, 2000, discloses a card holder to be worn around the neck. The whole device contains a cord which goes around the neck, a swivel which attaches to the lower end of the cord, a connecting piece between the swivel and the card holder, and the card holder. The cord is a conventional cord and the card holder hangs from the neck rather than clipping to something.

U.S. Pat. No. 6,301,751, issued to Ohlson Oct. 16, 2001, discloses a holding means which opens upwardly, a main part attached to the holding means, a hook-shaped device attached to the main part, and an identification card attached to the hook-shaped device.

U.S. Pat. No. 6,523,292, issued to Slavik Feb. 25, 2003, discloses a device for holding a greeting card to a flower stem. The device contains a clip for attaching to the stem of a plant, clothing, or a visor; an intermediate securing strand; and a casing for holding a greeting card or name tag. The casing of this invention is a hard hollow frame suitable for holding only a single card. Also, the clip is a plastic cylindrical spring which contains teeth designed to penetrate the object holding the clip.

While each of the above-described holders for cards or other objects is useful, there is room for improvement in several areas. The clip, itself should be sturdy and of such a nature that it has the ability to securely clip onto substrates of varying sizes ranging from single layers of fabric to automobile visors without doing damage to the substrate. The clip and the intermediate securing piece must be securely held to each other. It is desirable that the intermediate securing piece offers an information-carrying area. Finally, it is desirable for the card holder (hereinafter, carrier) to carry more than a single card. It is also desirable that a device be available which contains a clip securely attached to an intermediate securing piece which is attached to a second clip. Finally, it is desirable that a device be available which provides a clip which is securely attached to a card carrier, there being no danger of the clip and card carrier becoming detached.

BRIEF SUMMARY OF THE INVENTION

In a first embodiment of this invention, the invention relates to card carriers comprising a transparent case attached to a clip through an intermediate securing piece. In a second embodiment of this invention, a first clip is attached to an intermediate securing piece, which in turn is attached to at least one second clip. In a third, and most preferred, embodiment of this invention, a clip is attached directly to a transparent case. In all cases the clip is attached to the adjacent piece by a unique connection involving a connecting piece on two surfaces of one of the jaws of the clip.

Virtually any clip known in the art may be used in this invention. The clip may be the conventional and ubiquitous tension clip in the shape of an isosceles triangle having a pair of finger grips to enable easy opening of the clip. Spring clips are suitable for use in this invention. An example of a spring clip is the well-known clothes pin. A locking clip such as disclosed in U.S. Pat. No. 5,388,313 issued to Cameron Feb. 14, 1995 is also suitable for use in this invention. A single requirement is that the clip has a flat front surface for attachment to the connector piece. Thus, suitable clips have an open end of the clip which can attach to a portion of a garment or other substrate and one side of the clip has a flat surface.

In two embodiments of this invention, the clip is attached to an intermediate securing piece by means of a strong transparent connecting piece. In a third embodiment of this invention, the clip is attached directly to the card carrier by means of the connecting piece. The connecting piece is strong, tear resistant, transparent, and has qualities which allow it to firmly adhere or be attached to the clip, the intermediate securing piece, when present, and the carrier.

A first section of the connecting piece securely fits onto the inside surface of the front side of the clip. A second section of the connecting piece securely fits onto the outside surface of the front side of the clip. The sections of connecting piece are wider than the clip. The portions of the connecting piece which extend beyond the clip attach to each other, forming a splice which secures the connecting piece to the clip. In the first embodiment, from the front side of the clip, the connecting piece extends and is attached to the front surface of the intermediate securing piece and continues away from the clip to be attached to the card carrier. In the second embodiment, from the front side of the clip, the connecting piece extends from the front surface of a first clip to the front surface of the intermediate securing piece and continues away from the first clip to be attached to the front side of a second clip. In a third embodiment, from the front side of the clip, the connecting piece extends and attaches to the front side of the card carrier.

The intermediate securing piece is preferably made of sturdy paper, cloth, or plastic, but other suitable materials may be used. The intermediate securing piece should be wider than the clip. The length is variable, but it is preferred that it be long enough to carry visual information.

In a first embodiment of this invention, the end of the intermediate securing piece opposite the clip is attached to a carrier for a plurality of cards. In this embodiment, the connecting piece attaching to the intermediate securing piece extends beyond the intermediate securing piece onto the carrier. Staples, rivets, paste, glue, cement, or lamination may be used to help secure the connecting piece to the carrier. The carrier is a conventional multi-sectioned plastic card carrier having plastic sheets wherein each sheet contains an open pocket for receiving at least one card. The open ends of the pockets are directed toward the clip.

In a second embodiment of this invention, the intermediate securing piece has a first end and a second end. The first end of the intermediate securing piece is attached to the first clip. The second end of the intermediate securing piece is attached to a second clip. This allows a first clip to be attached to a substrate and an intermediate securing piece optionally having information thereon to be attached to a second clip which may be used to hold any desired object. If desired, additional clips may be attached to the intermediate securing piece.

In a third, and preferred, embodiment of this invention, the clip is attached directly to the card carrier. The connecting piece is connected to the front of the clip. The connecting piece attaches directly to the front surface of the card carrier.

A wide variety of attachment methods are available for attaching the intermediate securing piece to the carrier. A connecting piece splice similar to that used in attaching the clip to the intermediate securing piece is suitable. Also, glue, paste, cement, and lamination are suitable. Attaching aids such as staples or rivets may be used to provide a stronger attachment.

The carrier portion of the device of this invention may be used as a temporary holder of business cards. It may be used to hold driving directions to the visor of a car to allow hands-free driving. It may be used to hold coupons while shopping, reminder notes, check lists, calendars, pictures, etc. Accordingly, the carrier portion has no limitation as to size and shape except the obvious limitation that it must be suitable to be carried by the user and capable of carrying the intended cards. The carrier is preferably made of transparent pliable plastic.

DESCRIPTION OF THE SEVERAL VIEWS OF THE DRAWINGS

FIG. 10 is an elevational perspective view of a variety of the clips which are useful in the present invention.

FIG. 11 is an elevational perspective view of a variety of fastening means useful in connecting the intermediate securing piece to the carrier.

FIG. 15 is an exploded front elevational view of the third embodiment showing the several components of the device.

FIG. 16 is a front elevational view of the assembled third embodiment of this invention.

DETAILED DESCRIPTION OF THE INVENTION

Figure 1:
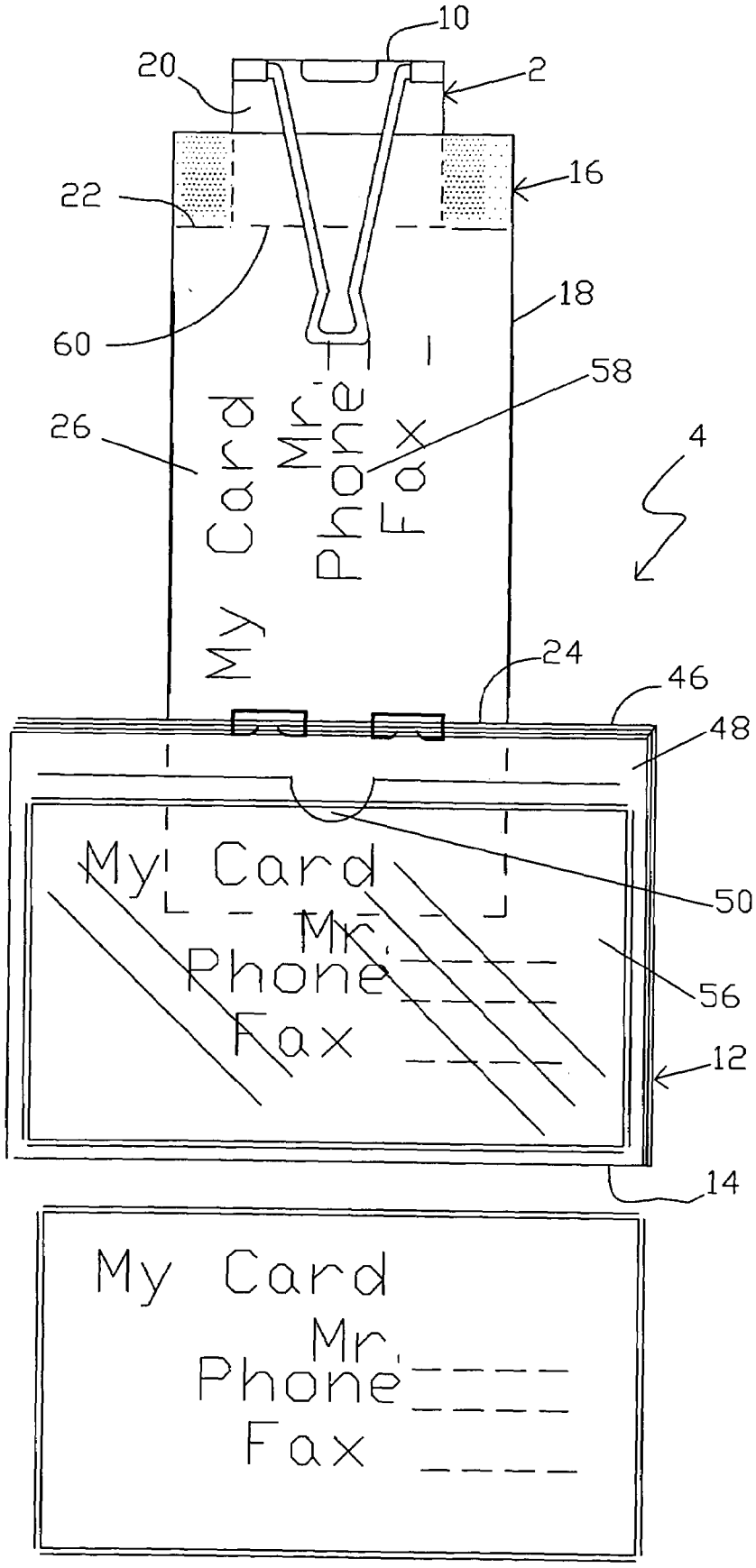
FIG. 1 is a front elevational view of a first embodiment of the present invention wherein there is a clip, a connector piece, an intermediate securing piece, and a carrier for a plurality of cards.

The invention will now be described with reference to the above drawings, wherein like descriptive numbers refer to like features throughout. In referring to directions, it will be assumed that the upper end of the clip 2 (or first clip 2) of the device 4, 6, 8 which is to be attached to a substrate is the proximal end 10 and that the lower end of the carrier 12 or the second clip 2' is the distal end 14.

Figure 2:
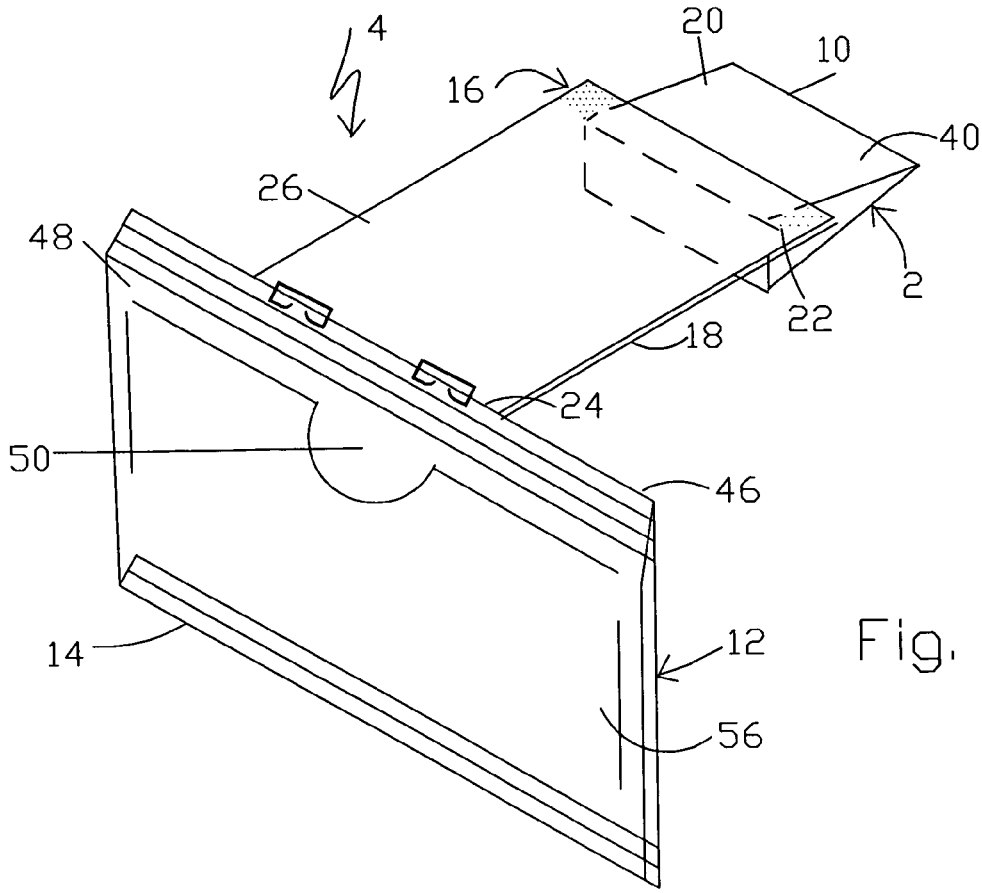
FIG. 2 is a perspective elevational view of a first embodiment of the present invention.
Figure 3:
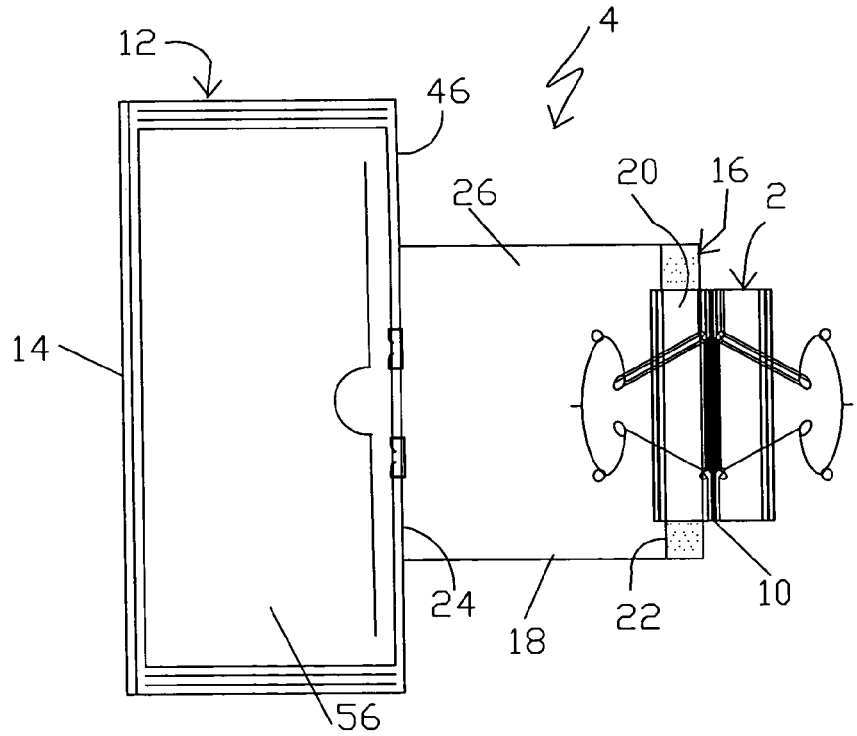
FIG. 3 is a front elevational view of a first embodiment of the present invention.
Figure 6:
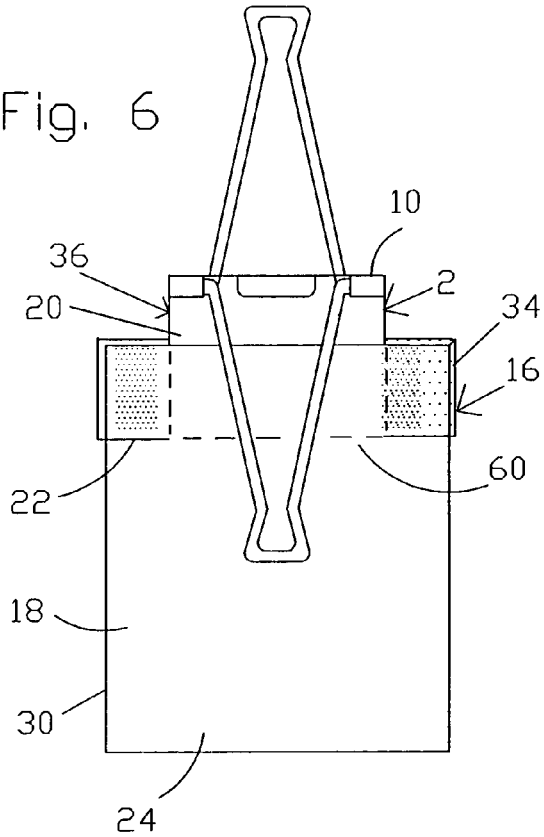
FIG. 6 is a front elevational view showing just the clip, the connector piece, and the intermediate securing piece useful for the first two embodiments of this invention.
Figure 7:
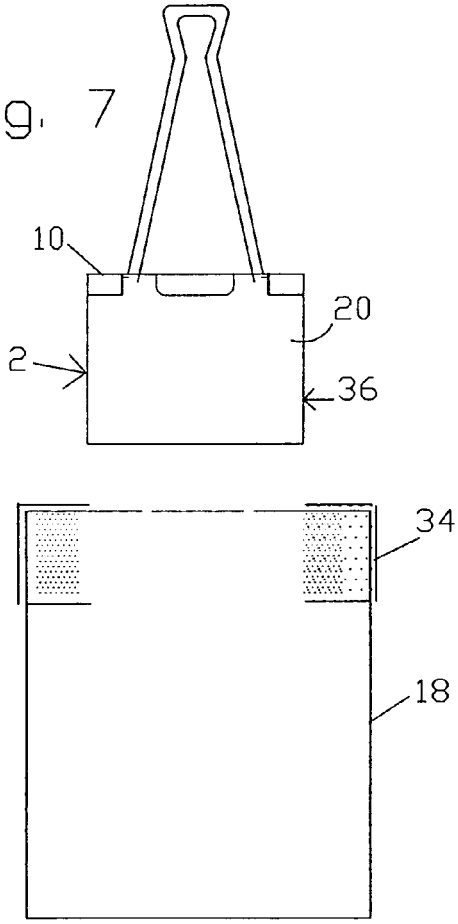
FIG. 7 is an exploded front elevational view of the clip, connector piece, and intermediate securing piece showing the attachment mechanism in greater detail.
Figure 8:
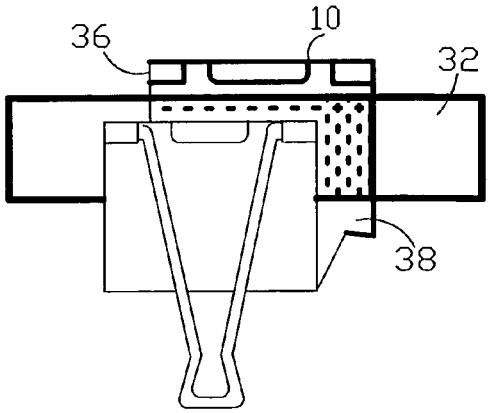
FIG. 8 is a perspective elevational view from the rear of the clip showing the connecting piece on the inner surface of the front side wherein the two pieces of the connecting piece are attached by adhesive.
Figure 9:
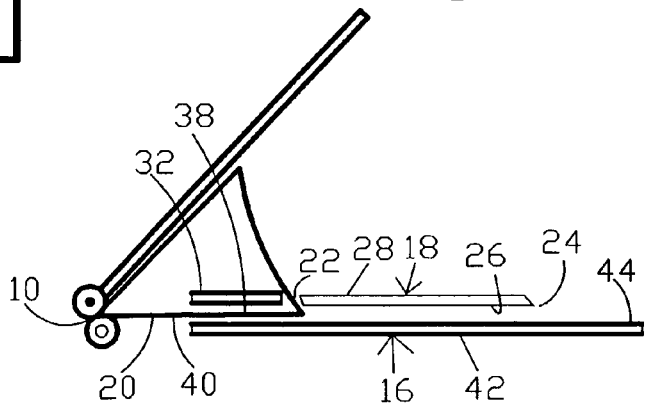
FIG. 9 is an exploded side cross-sectional view of the clip and the means for attachment of the clip to the intermediate securing piece.
Figure 17:
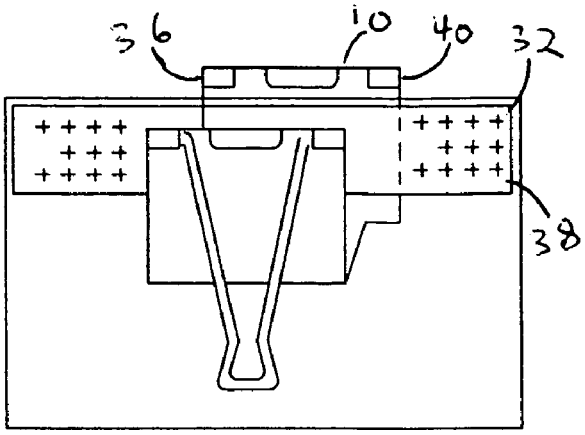
FIG. 17 is a perspective elevational view from the rear of the clip showing the connecting piece on the inner surface of the front side wherein the two pieces of connecting piece are attached by lamination.
Figure 18:
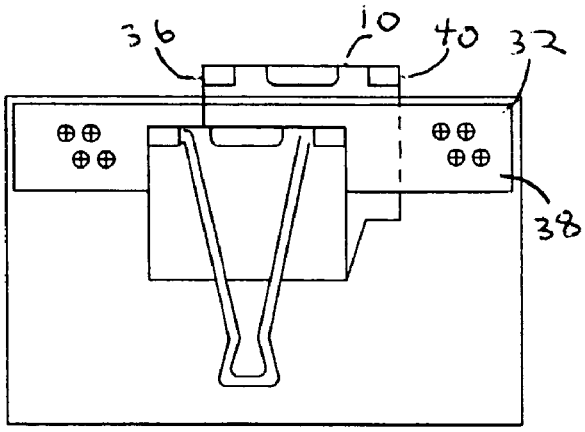
FIG. 18 is a perspective elevational view from the rear of the clip showing the connecting piece on the inner surface of the front side wherein the two pieces of connecting piece are attached by the punch-press process.
Figure 19:
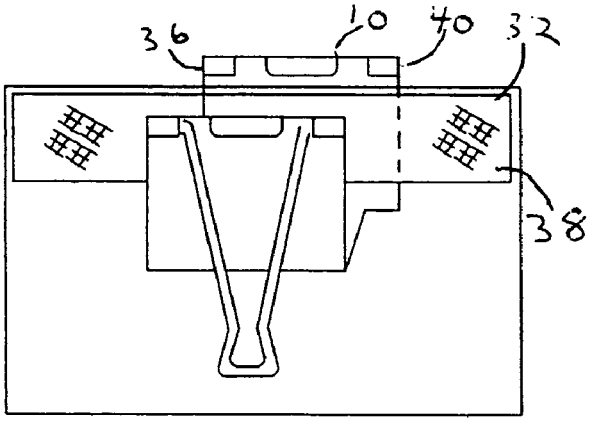
FIG. 19 is a perspective elevational view from the rear of the clip showing the connecting piece on the inner surface of the front side wherein the two pieces of connecting piece are attached by hook-and-eye attachment means.

With reference to FIGS. 1–3,6–11, and 17–19, a first embodiment of this invention will be described. The device 4 comprises a clip 2, a connecting piece 16, an intermediate securing piece 18, and a carrier 12.

Virtually any clip 2 having a flat front surface 20 is suitable for the present invention. Such clips 2 are well known in the art. One such clip 2 is described in U.S. Pat. Nos. 4,761,862, 5,533,236, 5,896,624, and 5,950,283, which are incorporated herein by reference. Spring clips, banker's clips, tarp clips, bulldog spring clips, and others are equally suitable. The sole requirement is that the clips 2 have at least one flat surface 20 for the connector piece 16.

The clip 2 is attached to an intermediate securing piece 18 by means of a strong transparent connecting piece 16. The connecting piece 16 is strong, tear resistant, transparent, and is firmly adhered or affixed to the clip 2, the intermediate securing piece 18, and the carrier 12.

The intermediate securing piece 18 is a plastic, cloth, or paper sheet having a proximal edge 22, a distal edge 24, a front surface 26, a rear surface 28, and two side edges 30. The intermediate securing piece 18 is wider than the clip 2 and is of any desired length. The lengths of the proximal 22 and distal 24 edges measure the width of the intermediate securing piece 18. The lengths of the side edges 30 measure the length of the intermediate securing piece 18.

The intermediate securing piece 18 is securely attached to the clip 2 in the following manner. A first piece 32 of clear connecting piece 16, preferably reinforced tape, having a side edge 34 substantially equal to the height of a side edge 36 of the clip 2 is securely fastened to the inner surface 38 of the front side 40 of the clip 2. The first piece of tape 32 is wider than the width of the clip 2 and extends beyond the side edges 36 of the clip 2. A second piece 42 of the same or similar tape has a width equal to the first piece 32 and a length such that it will cover the front side 20 of the clip 2 and extend distally to cover the intermediate securing piece 18 and extend beyond the intermediate securing piece 18. The second piece of tape 42 has the same width as the intermediate securing piece 18. The second piece of tape 42 is secured to the flat front surface 20 of the front side 40 of the clip 2. The portions of the second piece of tape 42 which extend beyond the front side 40 of the clip 2 attach to the corresponding portions of the first piece of tape 32. Attachment may be accomplished by adhesion, lamination, press-punch attachment, and hook-and-eye attachment. The front surface 26 of the intermediate securing piece 18 is attached to the rear surface 44 of the second piece of tape 42 at a point just distal to the clip 2. The timing of this connection is not critical and may be done prior to or following the connection of the second piece of tape 42 and the clip 2. In this manner a secure attachment is obtained between the clip 2 and the intermediate securing piece 18.

The carrier 12 is a transparent plastic card carrier 12. The carrier 12 has a proximal spine 46, a plurality, preferably four, of sheets 48, each sheet 48 having at least one pocket 50 therein wherein each pocket 50 opens proximally and may carry at least one card. These carriers 12 are conventional in the art and are extensively used in wallets and card carrying cases.

The above-described device 2 comprises a clip 2, a connector tape 16, an intermediate securing piece 18, and a carrier 12. The clip 2 and the intermediate securing piece 18 are firmly held together by the connector tape 16. The intermediate securing piece 18 and the carrier 12 are held together by adhesion, lamination, press-punch, or hook-and-eye attachments. The connector tape 16 extends beyond the distal end 24 of the intermediate securing piece 18. This attachment may be supplemented with additional holding means, such as staples 52, rivets 54, glue, paste, cement, and lamination. In this arrangement, the second tape 42 is adhered to the front surface 56 of the carrier 12. The device provides space 58 on the intermediate securing piece 18 for visual information.

Figure 4:
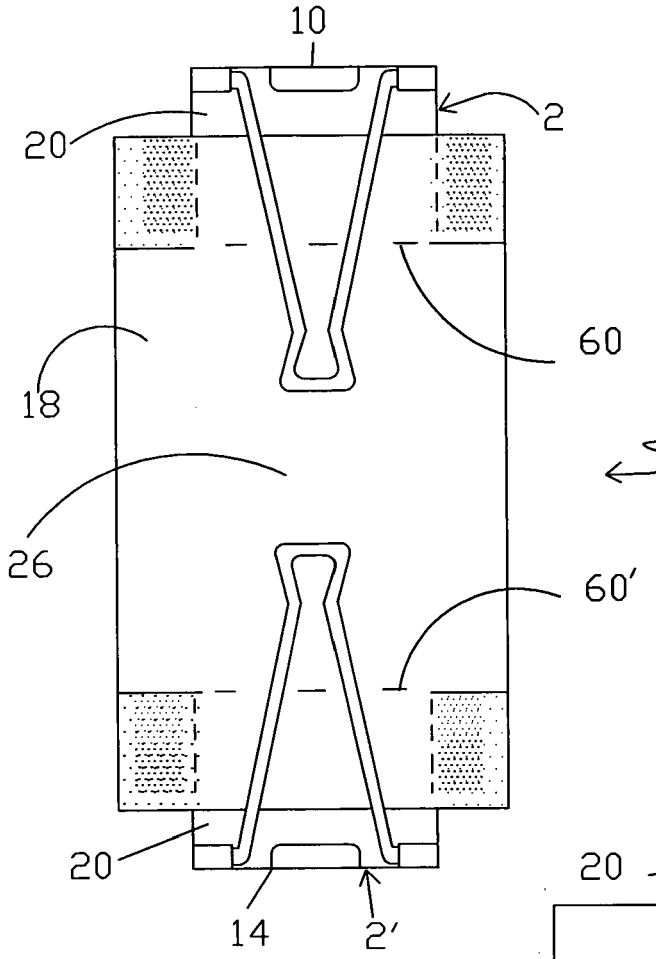
FIG. 4 is a front elevational view of a second embodiment of the present invention wherein there is a clip, a connector piece, an intermediate securing piece, and a second clip.
Figure 5:
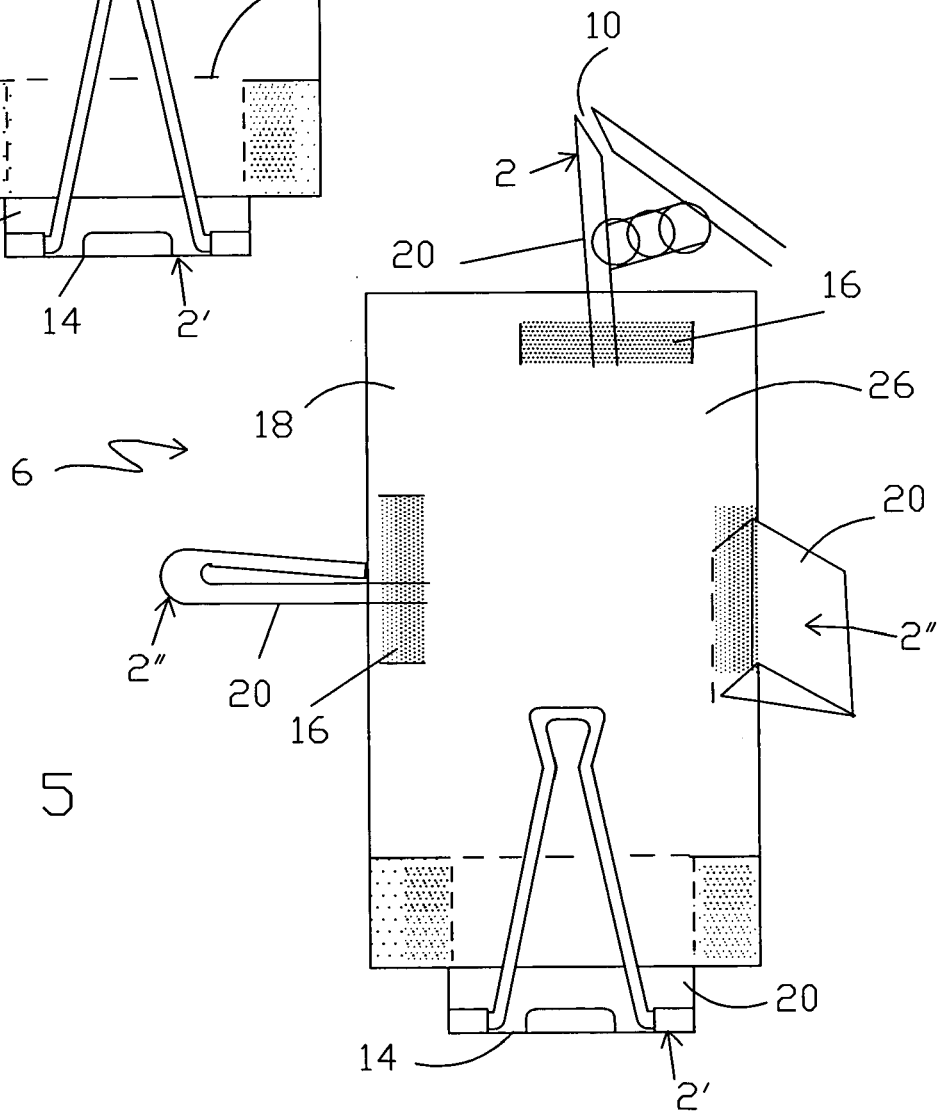
FIG. 5 is a front elevational view of a second embodiment of this invention wherein there are two additional side clips attached to the intermediate securing piece.
Figure 14:
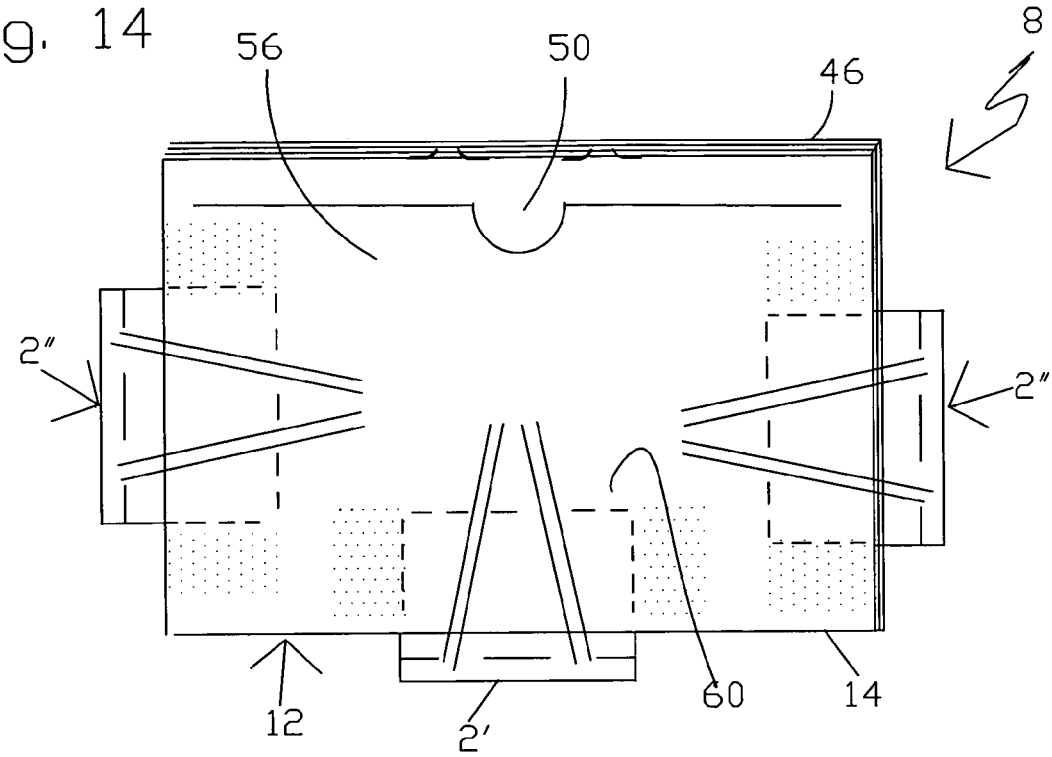
FIG. 14 is an elevational front view of the third embodiment of the invention showing three clips attached to a carrier.
Figure 13:
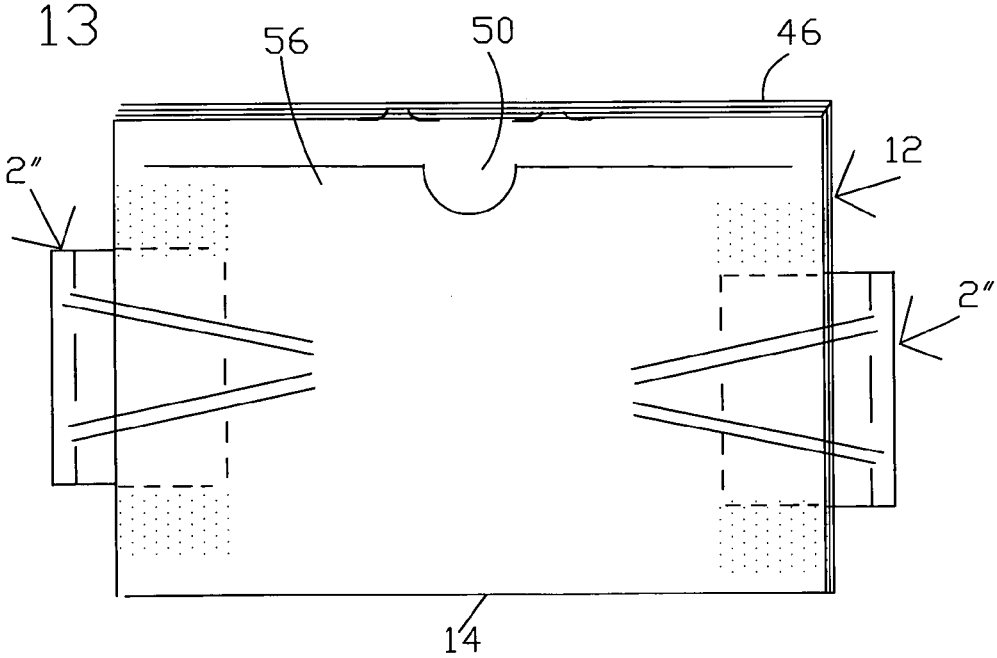
FIG. 13 is an elevational front view of the third embodiment of the invention showing two clips attached to a carrier.

With reference to FIGS. 4–11, 13, 14, and 17–19, a second embodiment of this invention will be described. The device 6 comprises a first clip 2, a connector tape 16, an intermediate securing piece 18, and a second clip 2'.

The first clip 2 of the device 6 is the same as that described above with reference to the first embodiment. The connector tape 16 is the same as that described above with reference to the first embodiment. The intermediate securing piece 18 is the same as that described above with reference to the first embodiment. The way in which the intermediate securing piece 18 is secured to the first clip 2 is the same as that described above with reference to the first embodiment. The second clip 2' of the device 6 may be identical to the first clip 2 or it may be different in some respects, such as size or type of clip. The second clip 2' is secured to the intermediate securing piece 18 in the same way as described above with reference to the first clip 2 in the first embodiment. If desired, additional clips 2" may be attached to the intermediate securing piece 18.

The second embodiment is thus a device 6 which comprises a first clip 2 which is secured by means of a connector tape 16 to an intermediate securing piece 18 wherein the intermediate securing piece 18 is firmly attached to a second clip 2'. There is space 58 for information on the intermediate securing piece 18.

In the device 6 of the second embodiment, there is an intermediate securing piece 18, two first connector pieces 32, a second connector piece 42, and first 2 and second 2' clips. In describing all parts of this embodiment the term "width" refers to that dimension which extends along a line from one side edge 34, 34' of a clip 2, 2' to the other side edge 34, 34' of a clip 2, 2' and the term "length" refers to that dimension which extends along a line longitudinally from the distal edge 60 to the proximal edge 60' of the first 2 and second 2' and from the first clip 2 to the second clip 2'. The "ends" of parts appear at either terminal of their lengths. The width of the first connector piece 32 is substantially equal to the width of the intermediate securing piece 18. The width of the second connector piece 42 is substantially equal to the width of the intermediate securing piece 18. The length of the first connector piece 32 is substantially equal to the length of a side edge 34 of the clip 2, 2' to which the first connector piece 32 is attached. The length of the second connector piece 42 is substantially equal to the sum of the lengths of the intermediate securing piece 18 and the two clips 2, 2'. The intermediate securing piece 18 is securely attached to the first 2 and second 2' clips. This attachment involves the use of two first connector pieces 32 which are preferably made of clear connecting tape 16 and a second connector piece 42 which is likewise preferably made of clear connecting tape 16. One first connector piece 32 is fastened to the inner surface 38 of the front side 40 of the first clip 2. Another first connector piece 32 is fastened to the inner surface 38' of the front side 40' of the second clip 2'. The side edges of the first connector piece 32 extend beyond the side edges 34, 34' of the first 2 and second 2' clips. The second connector piece 42 is secured to the flat front surfaces 20 of the front sides 40, 40' of the first 2 and second 2' clips and to those portions of the first connector piece 32 that extend beyond the edges 36, 36' of the first 2 and second 2' clips. The front surface 26 of the intermediate securing piece 18 is attached to the rear surface 44 of the second connector piece 42 and is thus securely attached to each of the clips 2, 2'.

The first clip 2 may be attached to a holding substrate such as a garment or automobile visor. The second clip 2' may be attached to an article which the user desires to display. This may be cards, larger sheets of paper, photographs or any other article desired to be handy and visible.

Figure 12:
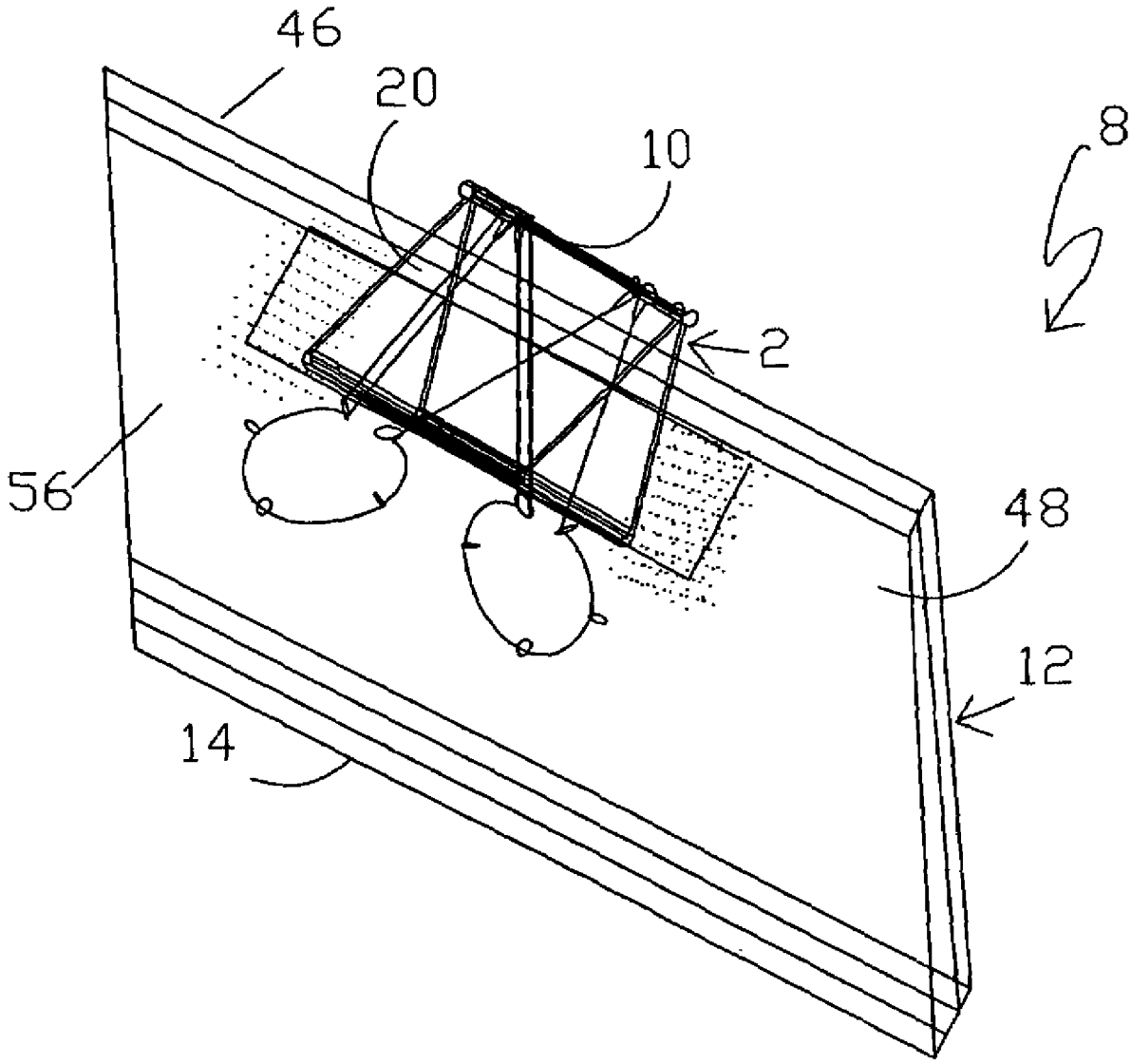
FIG. 12 is an elevational perspective view of the third embodiment of the present invention showing a clip attached directly to a carrier.

The third, and preferred, embodiment will be described with reference to FIGS. 6–14 and 17–19.

The device 8 of the third embodiment comprises a clip 2, a connector tape 16, and a carrier 12. The clip 2 may be the same as the clips 2 described relative to the first embodiment. A first piece 32 of the connector tape 16 is securely fastened to the inner surface 38 of the front side 40 of the clip 2. The first piece 32 of tape 16 is wider than the width of the clip 2 and extends beyond the side edges 34 of the clip 2. A second piece 42 of the same or similar tape 16 has a width equal to the first piece 32 and a length such that it will cover the front side 40 of the clip 2 and extend distally to cover a portion of the front surface 56 of the proximal portion of the carrier 12. The clip 2 and the carrier 12 are firmly held together by adhesion, lamination, press-punch attachment, or hook-and-eye attachment. The connector tape 16 extends beyond the distal end 60 of the clip 2. The attachment may be supplemented with additional holding means, such as staples 52, rivets 54, glue, paste, cement, and lamination. In this arrangement, the second piece 42 of the connector tape 16 is adhered to the front surface 56 of the carrier 12.

The connector piece 16 may attach to the proximal portion of either the front or rear side of the carrier 12.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A device for securing and displaying cards, comprising the parts of i) a first clip comprising a front side which has an inner surface, an outer surface and side edges; ii) a second clip comprising a front side which has an inner surface, an outer surface and side edges; iii) two first connector pieces having side edges; iv) one second connector piece having side edges and v) an intermediate securing piece; the configuration of the parts being such that the intermediate securing piece is wider than each of the first and second clips; the first connector pieces, when fastened to the inner surfaces of the front sides of the first and second clips, respectively, extend beyond the side edges of the first and second clips; the second connector piece has a width substantially equal to the width of each of the first connector pieces; and the second connector piece has a length such that, when the device is assembled, the second connector piece will cover the outer surface of the front side of the first clip, the intermediate securing piece, and the outer surface of the front side of the second clip; the assembly of the device results in one first connector piece being fastened to the inner surface of the front side of the first clip, the other first connector piece being fastened to the inner surface of the front side of the second clip, the side edges of the first connector pieces extending beyond the side edges of the first and second clips, the second connector piece being secured to the flat front surfaces of the front sides of the first and second clips, those portions of the first connector pieces that extend beyond the edges of the first and second clips and the front surface of the intermediate securing piece.

2. The device of claim 1, wherein the intermediate securing piece is a sheet of such a size and shape as to accommodate visual information.

3. The device of claim 1, wherein the first piece of the connector piece and the second piece of the connector piece are attached to each other by adhesion, lamination, press-punch or hook-and-eye attachment means.

* * * * *